US009721776B2

(12) United States Patent
Ogata et al.

(10) Patent No.: US 9,721,776 B2
(45) Date of Patent: Aug. 1, 2017

(54) SAMPLE PREPARATION METHOD AND SAMPLE PREPARATION DEVICE FOR MALDI INCLUDING DEPOSITING MATRIX SUBSTANCE ON SAMPLE SUBSTRATE IN TWO STEPS

(71) Applicants: SHIMADZU CORPORATION, Kyoto-shi, Kyoto (JP); KEIO UNIVERSITY, Tokyo (JP)

(72) Inventors: Koretsugu Ogata, Nagaokakyo (JP); Kazuteru Takahashi, Suita (JP); Akiko Kubo, Tokyo (JP); Makoto Suematsu, Tokyo (JP); Takushi Yamamoto, Amagasaki (JP)

(73) Assignees: SHIMADZU CORPORATION, Kyoto (JP); KEIO UNIVERSITY, Tokyo (JP)

( * ) Notice: Subject to any disclaimer, the term of this patent is extended or adjusted under 35 U.S.C. 154(b) by 0 days.

(21) Appl. No.: 14/781,950

(22) PCT Filed: Apr. 4, 2014

(86) PCT No.: PCT/JP2014/059946

§ 371 (c)(1),
(2) Date: Oct. 2, 2015

(87) PCT Pub. No.: WO2014/163179

PCT Pub. Date: Oct. 9, 2014

(65) Prior Publication Data

US 2016/0035553 A1 Feb. 4, 2016

(30) Foreign Application Priority Data

Apr. 4, 2013 (WO) ..... PCT/JP2013/060322

(51) Int. Cl.
*B05D 1/02* (2006.01)
*B05D 3/10* (2006.01)
(Continued)

(52) U.S. Cl.
CPC ..... *H01J 49/0418* (2013.01); *B05D 1/60* (2013.01); *B05D 3/107* (2013.01); *B05D 7/5483* (2013.01); *H01J 49/0004* (2013.01)

(58) Field of Classification Search
CPC ..... B05D 1/60; B05D 3/107; B05D 7/5483
See application file for complete search history.

(56) References Cited

U.S. PATENT DOCUMENTS 6,288,390 B1 * 9/2001 Siuzdak ..... H01J 49/164 250/288
6,569,383 B1 * 5/2003 Nelson ..... G01N 33/6848 422/412

(Continued)

FOREIGN PATENT DOCUMENTS

JP 2008-232842 A 10/2008

OTHER PUBLICATIONS

Cohen, Steven L., et al., "Influence of Matrix Solution Conditions on the MALDI-MS Analysis of Peptides and Proteins". Anal. Chem. 1996, 68, 31-37.*

(Continued)

*Primary Examiner* — Bret Chen
(74) *Attorney, Agent, or Firm* — Sughrue Mion, PLLC

(57) ABSTRACT

After a sample such as a biomedical tissue section is attached to an electrically-conductive slide glass (S1), the film layer of a matrix substance is appropriately formed by vapor deposition so as to cover the sample (S2). The crystal of the matrix substance in the film layer is very fine and uniform. Subsequently, the slide glass on which the matrix film layer is formed is placed in a vaporized solvent atmosphere, and the solvent infiltrates into the matrix film layer (S3). When the solvent sufficiently infiltrated is vaporized, a substance to be measured in the sample takes in the matrix and re-crystallized. Furthermore, the matrix film layer is formed again on the surface by the vapor deposition (S4).

(Continued)

The added matrix film layer absorbs excessive energy of a laser beam during MALDI, which suppresses the denaturation of the substance to be measured and the like, so that high detection sensitivity can be achieved while high spatial resolution is maintained.

4 Claims, 15 Drawing Sheets

(51) Int. Cl.

| | |
|---|---|
| ***H01J 49/04*** | (2006.01) |
| ***B05D 1/00*** | (2006.01) |
| ***B05D 7/00*** | (2006.01) |
| *H01J 49/00* | (2006.01) |

(56) References Cited

U.S. PATENT DOCUMENTS 7,411,183 B2 * 8/2008 Overney ..... H01J 49/0418 250/282
7,667,196 B2 * 2/2010 Schurenberg ..... G01N 1/2813 250/288
2004/0119010 A1 * 6/2004 Perryman ..... G01N 33/6851 250/281
2004/0119013 A1 * 6/2004 Schleifer ..... H01J 49/0418 250/288
2004/0185448 A1 * 9/2004 Lopez-Avila ..... H01J 49/0418 435/7.23
2006/0134720 A1 * 6/2006 Miyazaki ..... G01N 33/6821 435/23
2006/0261267 A1 * 11/2006 Sze ..... H01J 49/0418 250/288
2009/0045332 A1 * 2/2009 Yoshimura ..... H01J 49/0418 250/288
2011/0272373 A1 * 11/2011 Wojtowicz ..... A47B 87/0215 211/134
2012/0104247 A1 * 5/2012 Ogawa ..... G01N 1/06 250/288
2014/0084151 A1 * 3/2014 Ferguson ..... A61B 5/1172 250/282

OTHER PUBLICATIONS

Caprioli, Richard M., et al., "Molecular Imaging of Biological Samples: Localization of Peptides and Proteins Using MALDI-TOF MS". Anal. Chem. 1997, 69, 4751-4760.*
Hanton, Scott D., et al., "Extending the Solvent-Free MALDI Sample Preparation Method". J. Am. Soc. Mass Spectrom. 2005, 16, 90-93.*
Zagorevskii, Dmitri V., et al., "The effect of tetrahydrofuran as solvent on matrix-assisted laser desorption/ionization and electrospray ionization mass spectra of functional polystyrenes." Rapid Communications in Mass Spectrometry, 2006; 20: 178-180.*
Calderaro, Adriana, et al., "Matrix-assisted laser desorption/ionization time-of-flight (MALDI-TOF) mass spectrometry applied to virus identification". Scientific Reports, 4: 6803; DOI: 10.1038/srep06803. Oct. 30, 2014, pp. 1-10.*
Kiyoshi Ogawa et al., "Development of Microscopic Mass Spectrometer", Shimadzu Review, Shimadzu Corporation, Mar. 31, 2006, , pp. 125-135, vol. 62, No. 3/4.
Junhai Yang et al., "Matrix Sublimation/Recrystallization for Imaging Proteins by Mass Spectrometry at High Spatial Resolution", Analytical Chemistry, 2011, pp. 5728-5734, vol. 83.
International Search Report of PCT/JP2014/059946 dated Jun. 24, 2014 [PCT/ISA/210].
International Written Opinion for PCT/JP2014/059946, dated Jun. 24, 2014 [PCT/ISA/237].
Communication dated Feb. 23, 2017 from the State Intellectual Property Office of the P.R.C. in counterpart Application No. 201480019830.7.

* cited by examiner

VAPOR DEPOSITION METHOD

VAPOR DEPOSITION + SPRAY METHOD

SPRAY METHOD

VAPOR DEPOSITION + SPRAY METHOD

VAPOR DEPOSITION METHOD

VAPOR DEPOSITION METHOD

VAPOR DEPOSITION + SPRAY METHOD

SPRAY METHOD

VAPOR DEPOSITION + SPRAY METHOD

VAPOR DEPOSITION METHOD

Fig. 12A
MICROSCOPIC OBSERVATION IMAGE AFTER APPLICATION
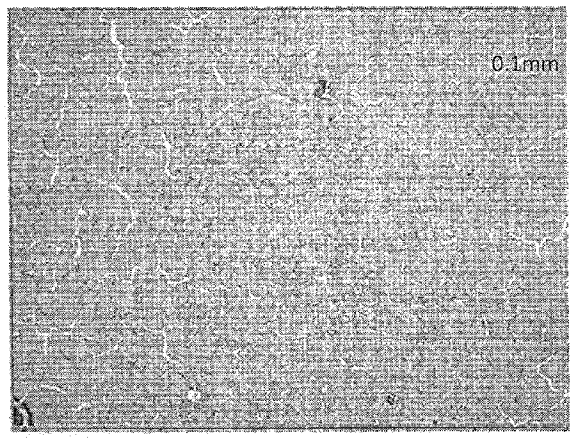
Fig. 12B
MASS SPECTRUM
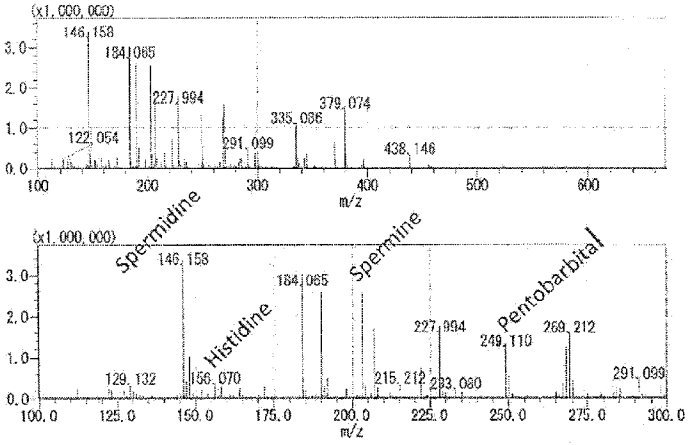
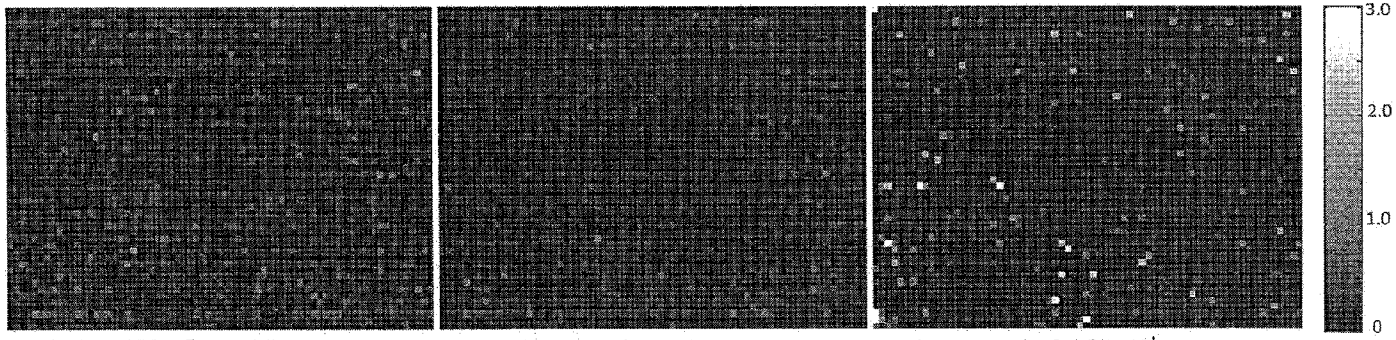
Fig. 12C
MS IMAGING IMAGES Fig. 13A
MICROSCOPIC OBSERVATION IMAGE AFTER APPLICATION
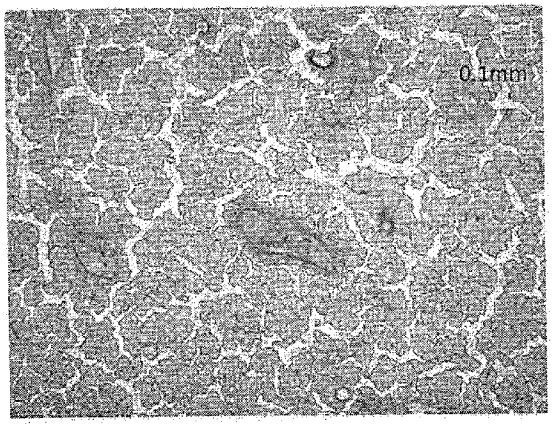
Fig. 13B
MASS SPECTRUM
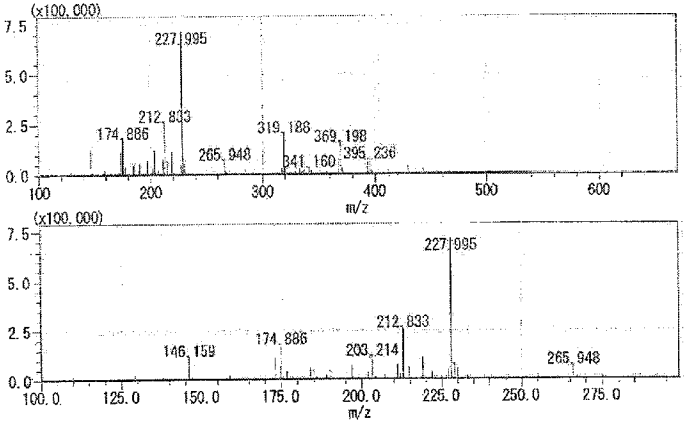
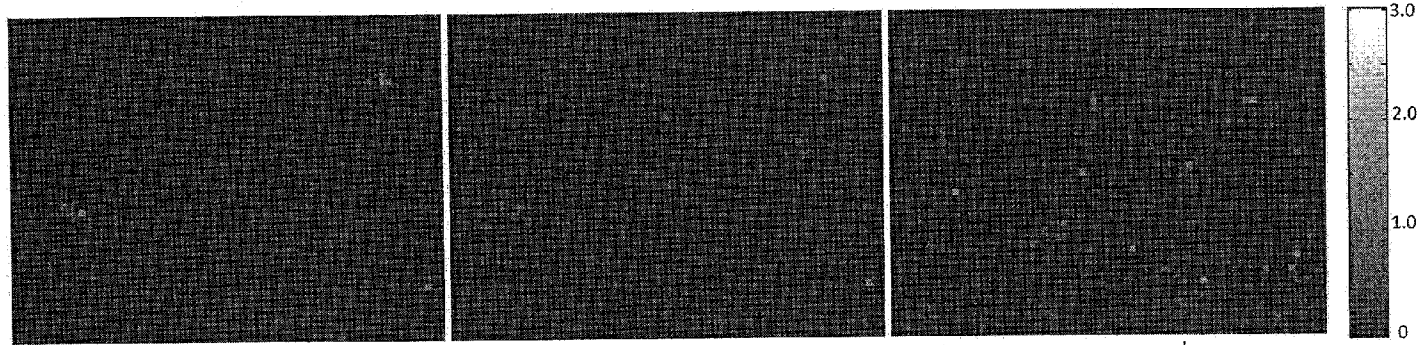
Fig. 13C
MS IMAGING IMAGES Fig. 14A
MICROSCOPIC OBSERVATION IMAGE AFTER APPLICATION
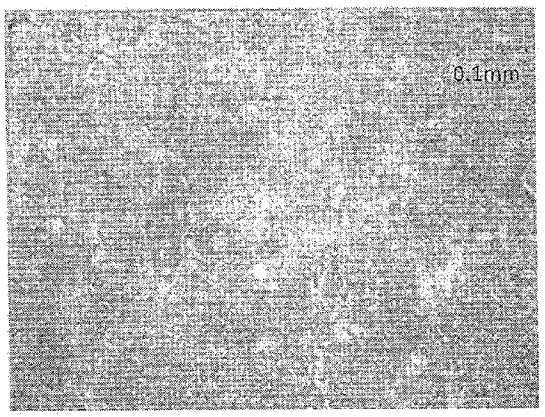
Fig. 14B
MASS SPECTRUM
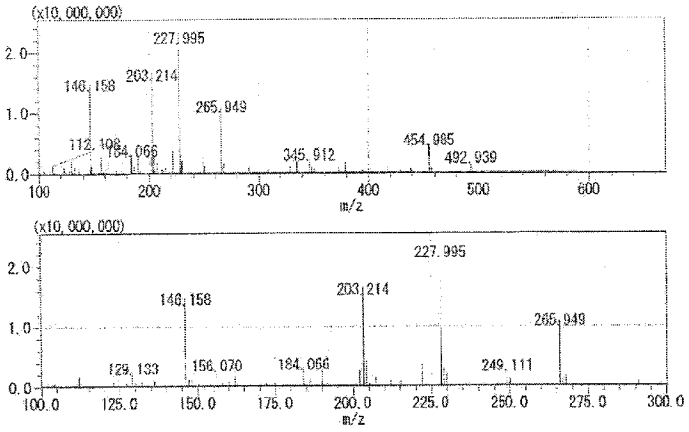
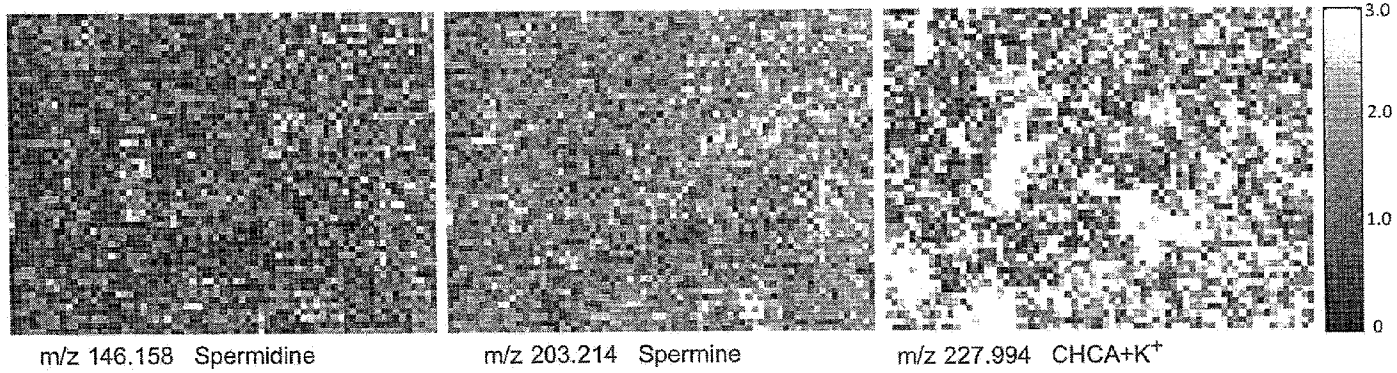
Fig. 14C
MS IMAGING IMAGES Fig. 15A
MICROSCOPIC OBSERVATION IMAGE AFTER APPLICATION
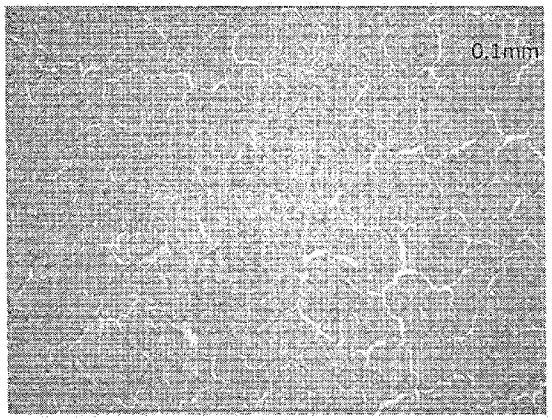
Fig. 15B
MASS SPECTRUM
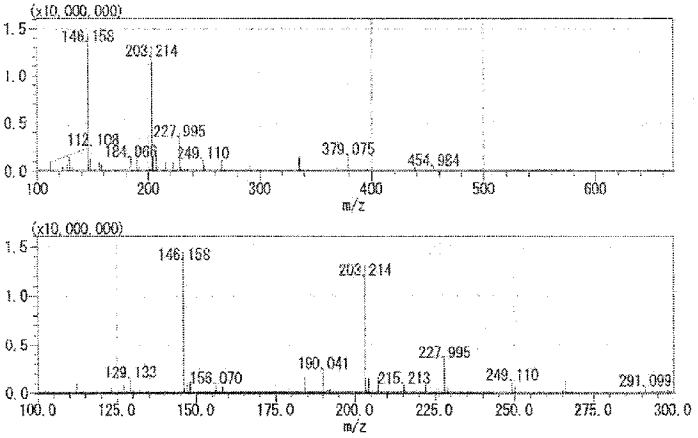
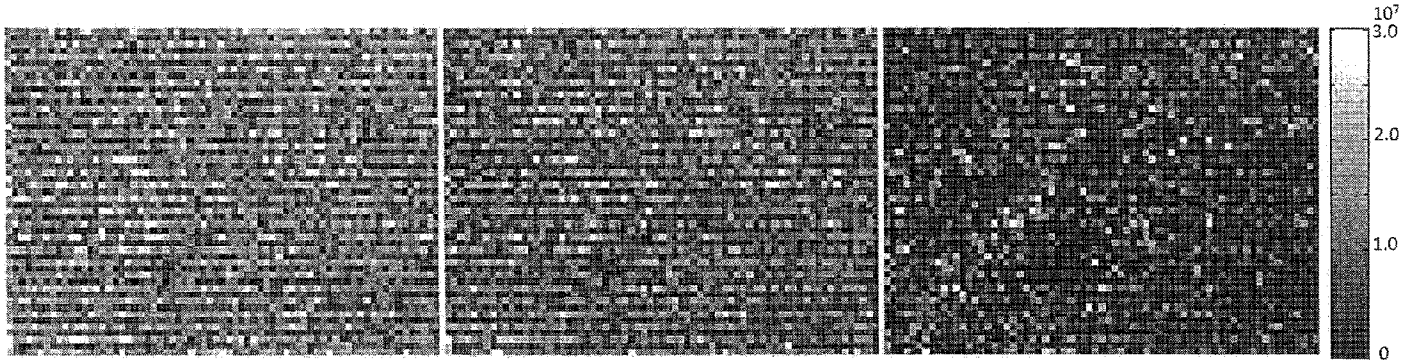
Fig. 15C
MS IMAGING IMAGES Fig. 16A
MICROSCOPIC OBSERVATION IMAGE AFTER APPLICATION
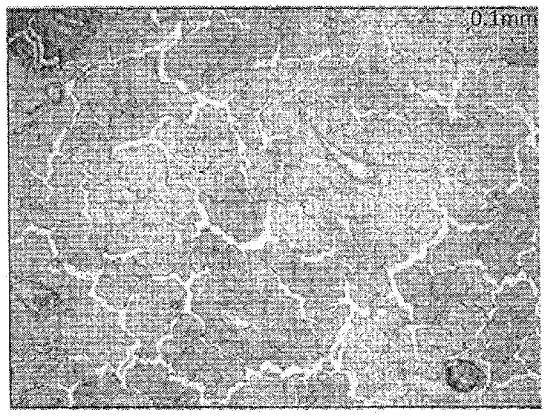
Fig. 16B
MASS SPECTRUM
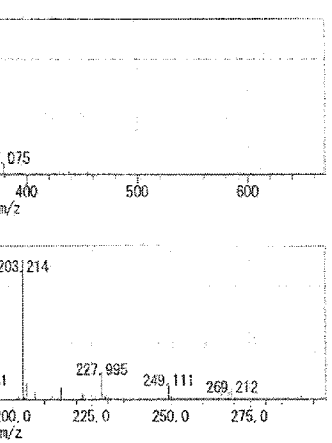
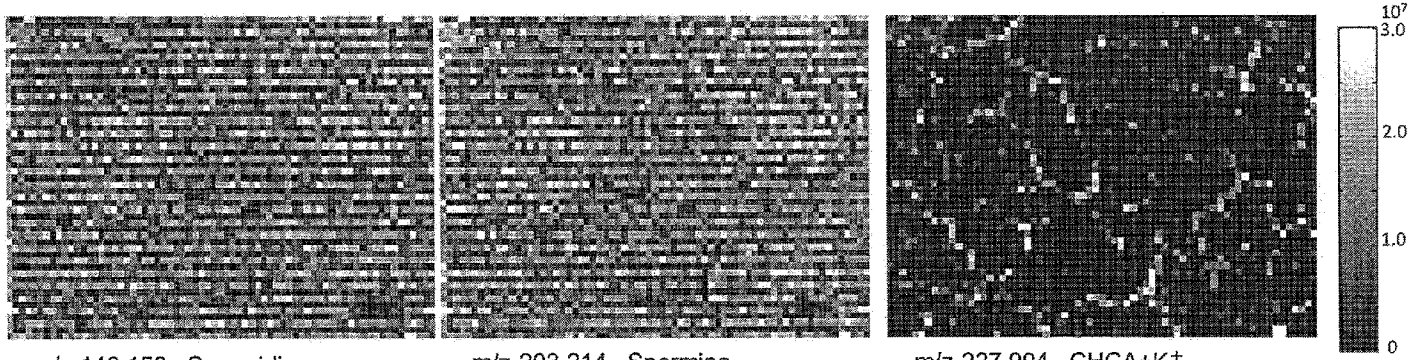
Fig. 16C
MS IMAGING IMAGES

Fig. 17A

COMPARISON OF PEAK AREA

| | Spermidine | Spermine | CHCA+K |
|---|---|---|---|
| Sublimation only | 5837645 | 4903790 | 3315998 |
| Sublimation + solvent spray | 218277 | 248277 | 1348788 |
| Sublimation + CHCA spray | 23473736 | 31721462 | 46435384 |
| Sublimation + solvent nebulizer | 23556822 | 25000196 | 7370630 |
| Sublimation + CHCA nebulizer | 19384438 | 23388146 | 4520615 |

Fig. 17B

COMPARISON OF INTENSITY RATIO TO MATRIX PEAK

| | Spermidine | Spermine | CHCA+K |
|---|---|---|---|
| Sublimation only | 1.760 | 1.479 | 1.000 |
| Sublimation + solvent spray | 0.162 | 0.184 | 1.000 |
| Sublimation + CHCA spray | 0.506 | 0.683 | 1.000 |
| Sublimation + solvent nebulizer | 3.196 | 3.392 | 1.000 |
| Sublimation + CHCA nebulizer | 4.288 | 5.174 | 1.000 |

Fig. 17C

COMPARISON OF INTENSITY RATIO IN CASE OF ONLY VAPOR DEPOSITION

| | Spermidine | Spermine | CHCA+K |
|---|---|---|---|
| Sublimation only | 1.000 | 1.000 | 1.000 |
| Sublimation + solvent spray | 0.037 | 0.051 | 0.407 |
| Sublimation + CHCA spray | 4.021 | 6.469 | 14.003 |
| Sublimation + solvent nebulizer | 4.035 | 5.098 | 2.223 |
| Sublimation + CHCA nebulizer | 3.320592122 | 4.769402034 | 1.363274345 |

SAMPLE PREPARATION METHOD AND SAMPLE PREPARATION DEVICE FOR MALDI INCLUDING DEPOSITING MATRIX SUBSTANCE ON SAMPLE SUBSTRATE IN TWO STEPS

CROSS REFERENCE TO RELATED APPLICATIONS

This application is a National Stage of International Application No. PCT/JP2014/059946, filed Apr. 4, 2014, claiming priority based on International Application No. PCT/JP2013/060322, filed Apr. 4, 2013, the contents of all of which are incorporated herein by reference in their entirety.

TECHNICAL FIELD

The present invention relates to a method for preparing a sample to conduct mass spectroscopy using a matrix assisted laser desorption/ionization (MALDI) method, and a sample preparation device used to prepare the sample in accordance with the method, and more particularly relates to a sample preparation method and a sample preparation device suitable for mass spectroscopy imaging (MS imaging).

BACKGROUND ART

The MALDI method is a technique for premixing a matrix substance, which easily absorbs a laser beam and is easily ionized, with a sample to be measured, and for ionizing the sample by irradiating this with the laser beam, to analyze the sample that is hard to absorb the laser beam or the sample such as protein, which is prone to suffer damage due to the laser beam. Generally, the matrix substance is added to the sample as a solution, and this matrix solution takes in the substance to be measured which is included in the sample. Then, it is dried and the solvent of the solution is vaporized, and crystal grains inclusive of the substance to be measured precipitate. When the laser beam is irradiated on this, the substance to be measured is ionized through the interaction of the substance to be measured, the matrix substance, and the laser beam. The MALDI method makes it possible to conduct an analysis minimizing break up of high molecular compound having large molecular weight. In addition to that, the MALDI method has high sensitivity suitable for micro amount analysis so that it is used in various fields such as life science in recent years.

The matrix substances for MALDI are appropriately selected in accordance with types, characteristics, and ion polarities of a substance to be measured, and representative substances include 1,4-bisbenzene, 1,8,9-trihydroxy anthracene, 2,4,6-trihydroxy acetophenone, 2,5-dihydroxybenzoic acid, 2-(4-hydroxy phenyl azo) benzoic acid, 2-aminobenzoic acid, 3-aminopyrazine-2-carboxylic acid, 3-hydroxypicolinic acid, 4-hydroxy-3-methoxycinnamic acid, trans-indoleacrylic acid, 2,6-dihydroxy acetophenone, 5-methoxysalicylic acid, 5-chlorosalicylic acid, 9-anthracenecarboxylic acid, indoleacetic acid, trans-3-dimethoxy-hydroxycinnamic acid, α-cyano-4-hydroxycinnamic acid, 1,4-diphenyl butadiene, 3,4-dihydroxycinnamic acid and 9-aminoacridine, and the like.

In recent years, attention has been paid to a mass spectroscopy imaging method of directly visualizing two-dimensional distribution of biomolecules or metabolites on a section of a living tissue by use of a MALDI mass spectrometer, and devices for this have been developed (see Non-Patent Literature 1, for example). In the mass spectroscopy imaging method, a two-dimensional image representing the intensity distribution of ions having a specific mass-to-charge ratio can be obtained on a sample such as a living tissue section. Accordingly, it can be used to detect the distribution of a specific substance in a pathological issue such as cancer, which facilitates figuring out the progress of disease or verifying the therapeutic effect of prescription. Thus, it is expected to be used for various applications in the fields of medicine, drug development, and life science. It is noted that, in Non-Patent Literature 1, the mass spectrometer is called as a microscopic mass spectrometer since a mass spectrometer that is capable of mass spectroscopy imaging is normally capable of microscopic observation, but, in the present specification, it is referred to as an imaging mass spectrometer so as to clarify that the device is aimed at conducting a mass spectroscopy imaging.

In the mass spectroscopy imaging method, high spatial resolution is required to obtain a mass spectroscopy imaging image to which the distribution of a target substance is accurately reflected. One of significant factors that determines the spatial resolution of the imaging mass spectrometer utilizing MALDI is the grain size of the matrix substance in the prepared sample and its uniformity. Conventionally used methods of adding matrix with regard to the mass spectroscopy imaging method include the method of injecting matrix solution in an array form to a sample by an ink jet method, and the method of blowing with a spray or the like and applying the matrix solution to the sample. However, these methods have difficulties in enhancing the spatial resolution of mass spectroscopy imaging because of the following reasons.

When the matrix solution is sprayed on the sample with a spray device, for example, the crystal grain takes in the substance to be measured from a broader area than a targeted area. As a result, the positional information of the substance to be measured on the sample is impaired, and the boundary line of the region where a certain substance exists becomes unclear. On the other hand, in the case of the method of injecting the matrix solution by the ink jet method to add the matrix solution to the sample, measuring positions (spots) to which the matrix solution is added are placed in an array form, and therefore positional relationship between the measuring positions is secured. However, the size of the measuring positions depends on the liquid amount of the matrix solution, and may have a diameter of tens to hundred micrometers on the sample due to the restriction of the injectable minimum liquid amount. This prevents the size of the measuring positions from being reduced greatly, which automatically determines the spatial resolution. It is noted that this problem has been pointed out in Patent Literature 1.

When 2,5-dihydroxybenzoic acid (DHB), which is often used as the matrix substance, or the like is sprayed with a spray device, the crystals are formed in needles, having various lengths. In the process of ionization, due to the variety of the size of the crystals, the positional information of the substance to be measured on the sample is impaired, which makes it difficult to enhance the spatial resolution.

In view of the problem described above, Patent Literature 1 proposes a sample preparation method of, instead of using conventional matrix substance, attaching minute particles to a sample, where every particle has a core made of a metallic oxide covered with polymer. Results of mass spectroscopy imaging of a cerebellar section of a rat by this method are shown in Patent Literature 1. However, in this sample preparation method, the preparation procedure is complicated, and an increase in cost is inevitable because inexpensive existing matrix substances cannot be used. Also, in the case of existing matrix substances, components suited to be ionized by every substance are known, and therefore an appropriate matrix substance can be selected in accordance with the substance to be measured. However, in the new sample preparation method described above, there is no established knowledge what component can be detected or what component cannot be detected in an analysis.

Non-Patent Literature 2 discloses a sample preparation method that achieves high spatial resolution by use of existing matrix substances. In this method, in order to conduct a mass spectroscopy imaging of protein, a matrix film layer is formed by a vacuum vapor deposition method on the surface of a slide glass on which a sample is attached, and subsequently, the slide glass is placed in an ambient including vaporized solvent such as methanol, which enhances re-crystallization of the matrix substance inclusive of the substance to be measured. The inventors of the instant application have verified by experiment that this sample preparation method is quite effective in improving the spatial resolution of the mass spectroscopy imaging.

However, according to the experiments by the inventors of the instant application, it is revealed that the sample preparation method disclosed in Non-Patent Literature 2 is difficult to improve detection sensitivity.

CITATION LIST

Patent Literature

Patent Literature 1: JP 2008-232842 A

Non-Patent Literature

Non-Patent Literature 1: Kiyoshi Ogawa et al., "Development of Microscopic Mass Spectrometer", Shimadzu Review, Shimadzu Corporation, Mar. 31, 2006, Vol. 62, No. 3/4, pp. 125-135

Non-Patent Literature 2: Junhai Yang et al., "Matrix Sublimation/Recrystallization for Imaging Proteins by Mass Spectrometry at High Spatial Resolution", Analytical Chemistry, 2011, 83, pp. 5728-5734

SUMMARY OF INVENTION

Technical Problem

The present invention has been made to solve the problems above, and it is an object of the present invention to provide a sample preparation method and a sample preparation device for MALDI, which achieve high spatial resolution, when mass spectroscopy imaging is conducted, and have high detection sensitivity, and reduce costs.

Solution to Problem

In the first mode of a sample preparation method for MALDI according to the present invention achieved to solve the problems above, the sample preparation method for preparing a sample for mass spectroscopy using a matrix assisted laser desorption ionization method is characterized by executing:

a) a matrix depositing step for vaporizing a matrix substance in vacuum and depositing the matrix substance to form a matrix film layer on a surface of a sample substrate on which a sample to be measured is placed, b) a solvent introducing step for bringing a predetermined solvent in gaseous or liquid state into contact with a surface of the matrix film layer formed on the sample substrate so as to infiltrate the solvent into the matrix film layer, and c) a matrix re-depositing step for vaporizing the matrix substance in vacuum and depositing the matrix substance again on the surface of the matrix film layer in a state where the solvent is infiltrated, or in a state where the infiltrated solvent is volatilized.

Here, "a sample to be measured" is an object targeted for the ionization with MALDI and the implementation of mass spectroscopy, in particular, an object targeted for mass spectroscopy imaging by use of an imaging mass spectrometer utilizing MALDI, for example, a living tissue section that is taken out from a living organism and sliced. Also, "sample substrate" is, for example, an electrically-conductive slide glass, or a metal plate such as stainless steel plate.

For the "matrix substance", matrix substances of various types used in conventional sample preparation method for MALDI can be employed. For the "solvent", solvents of various types used in preparing matrix solution in conventional sample preparation method for MALDI can be employed. The user (the measurement operator) can select the matrix substances and the solvents appropriately in accordance with the type of the substance to be measured and included in the sample, or other factors.

In the sample preparation method for MALDI of the first mode according to the present invention, after the sample to be measured is placed on the surface of the sample substrate, the matrix substance is deposited on the surface of the sample substrate so as to cover the sample by the vacuum vapor deposition in the matrix depositing step, whereby the matrix film layer is formed. Subsequently, in the solvent introducing step, a predetermined solvent in gaseous or liquid state is brought into contact with the surface of the matrix film layer formed on the sample substrate so as to infiltrate the solvent into the matrix film layer. Then, after or before the solvent is dried, the matrix substance is deposited again by the vacuum vapor deposition on the surface of the matrix film layer previously formed.

It is noted that, even when the vacuum vapor deposition of the matrix substance is carried out in a state where the solvent is not dried, the solvent infiltrated in the matrix film layer rapidly vaporizes when the sample substrate is placed in the vacuum atmosphere, and is removed from the matrix film layer. Accordingly, even when the vacuum vapor deposition is started before the solvent is fully dried, a new matrix substance is deposited onto the matrix film layer in a state where the matrix film layer is effectively dried.

The crystals of the matrix substance in the matrix film layer formed by the vacuum vapor deposition are very fine and uniform. In the process of the vaporization of the solvent infiltrated in the matrix film layer, the crystals of the matrix substance take in the substance to be measured in the sample and re-crystallize. In the matrix re-depositing step, a thin matrix film layer is formed on the surface of the matrix film layer including the fine crystals in which the substance to be measured is distributed. Some substance to be measured, especially those originating from a living organism, protein and the like, are prone to suffer damage by a laser beam. Though the matrix substance mixed with the substance to be measured is expected to reduce the damage by the laser beam, such effect is weak if the crystals are very fine, compared with large crystals.

In contrast, the matrix film layer that does not include the substance to be measured is formed on the surface of the sample prepared by the sample preparation method for MALDI according to the present invention, and therefore the matrix film layer on the surface adequately absorbs the laser beam during ionization by MALDI, which suppresses the damage to the substance to be measured. As a result, the amount of generated ions increases, which improves the detection sensitivity, compared with a case where no such process is executed as to re-deposit the matrix substance after solvent infiltration.

In the sample preparation method for MALDI of the first mode according to the present invention, for example, in the solvent introducing step, the sample substrate on which the matrix film layer is formed may be left in a container filled with vaporized solvent. The vaporized solvent contacts the surface of the matrix film layer, and the state is maintained for a predetermined period of time, so that the solvent infiltrates into the matrix film layer.

Alternatively, in the solvent introducing step, liquid solvent may be sprayed on the surface of the matrix film layer formed on the sample substrate with a spray device. The liquid solvent contacts the surface of the matrix film layer, and infiltrates into the matrix film layer.

The former technique is favorable because the matrix depositing step and the matrix re-depositing step can be performed successively in a device, as described later. On the other hand, this technique requires some time for the solvent to infiltrate into the matrix film layer, and therefore it takes a longer time for the solvent introducing step. In contrast, in the latter technique, more solvents are supplied to the surface of the matrix film layer in a short period of time, and therefore the solvents can be infiltrated into the matrix film layer in a shorter period of time.

A sample preparation device for MALDI according to the present invention, which employs the former technique, in particular, as the solvent introducing step, includes:

a) a container capable of being sealed in a hermetical manner;

b) an evacuation unit configured to maintain vacuum in the container;

c) a sample holding unit configured to hold the sample substrate on which the sample to be measured is placed in the container;

d) a vapor deposition source arranged to face a sample placement surface of the sample substrate held by the sample holding unit and configured to heat the matrix substance in the container to deposit the matrix substance on the sample substrate; and e) a vaporized solvent supplying unit configured to introduce the vaporized solvent into the container in a state where evacuation is not conducted by the evacuation unit, wherein the matrix depositing step, the solvent introducing step, and the matrix re-depositing step can be sequentially executed in a state where the sample substrate is held by the sample holding unit in the container.

In the sample preparation device for MALDI according to the present invention, various kinds of operations to execute the matrix depositing step, the solvent introducing step, and the matrix re-depositing step may be manually performed by a user, or may be automatically performed by a control unit that controls each unit in accordance with programs set in advance.

In the sample preparation device for MALDI according to the present invention, when the sample substrate on which the sample is placed is set in the container, which is evacuated by the evacuation unit, the sample for MALDI can be prepared without taking out the sample substrate from the container during the process. In particular, when the processing of the steps are made to be automatically performed, it is not necessary for the measurement operator to perform any operation during the process, which saves labor and avoids variation in the finishing quality of the sample which normally occurs depending on the skill and experiences of the measurement operator.

In the second mode of the sample preparation method for MALDI according to the present invention made to solve the problems above, the sample preparation method for preparing a sample for mass spectroscopy using a matrix assisted laser desorption ionization method is characterized by executing:

a) a matrix depositing step for vaporizing a matrix substance in vacuum and depositing the matrix substance to form a matrix film layer on a surface of a sample substrate on which a sample to be measured is placed; and b) a solution introducing step for spraying a matrix solution having a concentration lower than that of a matrix solution used of a matrix application method on a surface of the matrix film layer formed on the sample substrate to infiltrate the solution into the matrix film layer.

Here, the concentration of the matrix solution used in the solution introducing step is lower than that of the matrix solution used in a general matrix application method. Generally, a matrix saturated solution is used in the matrix application method, but in the second mode, it is preferred to use a matrix solution having the concentration of about half to one fifth of that of the saturated solution.

In the sample preparation method for MALDI of the second mode, when the low concentration matrix solution is sprayed on the surface of the matrix film layer on the sample substrate in the solution introducing step, the solution is infiltrated into the matrix film layer, and in the process in which mainly the solvent in the solution reaches the sample and vaporizes, crystals of the matrix substance in the matrix film layer take in the substance to be measured in the sample and re-crystallize. On the other hand, the matrix substance included in the low concentration matrix solution does not infiltrate into the matrix film layer having fine crystals, and therefore remains in the vicinity of the surface. As a result, similarly to the sample preparation method in the first mode, a sample is prepared in which the matrix film layer of very fine crystals on which the substance to be measured is distributed is covered with a thin matrix film. Thus the actions and effects similar to those of the sample preparation method in the first mode is achieved.

Advantageous Effects of the Invention

According to the sample preparation method for MALDI of the present invention, when the mass spectroscopy imaging is performed, it is possible to prepare the sample that can achieve both high spatial resolution and high detection sensitivity. Also, in the sample preparation method for MALDI according to the present invention, the matrix substance is not limited to specific substance, but various matrix substances used in conventional general sample preparation methods can be used. This leads to easy and low-cost procurement of the matrix substances, and the user is endowed with the information for each matrix substance what component can be detected or what component cannot be detected with the matrix substance.

According to the sample preparation device for MALDI of the present invention, the sample for MALDI can be prepared with one device, which saves the preparation labor, and produces samples having high measurement reproducibility.

BRIEF DESCRIPTION OF DRAWINGS

FIGS. 12A to 12C are diagrams in a case where only vapor deposition is conducted in a second experiment, and FIG. 12A illustrates a microscopic observation image of a sample surface after matrix application, and FIG. 12B illustrates a mass spectrum acquired by averaging mass spectra obtained at all analytical points in an analytical range, and FIG. 12C illustrates representative mass spectroscopy imaging images.

FIGS. 13A to 13C are diagrams in a case where only a solvent is sprayed and applied after the vapor deposition in the second experiment, and FIG. 13A illustrates a microscopic observation image of a sample surface after matrix application, and FIG. 13B illustrates a mass spectrum acquired by averaging mass spectra obtained at all analytical points in an analytical range, and FIG. 13C illustrates representative mass spectroscopy imaging images.

FIGS. 14A to 14C are diagrams in a case where a matrix solution having low concentration is sprayed and applied after the vapor deposition in the second experiment, and FIG. 14A illustrates a microscopic observation image of a sample surface after matrix application, and FIG. 14B illustrates a mass spectrum acquired by averaging mass spectra obtained at all analytical points in an analytical range, and FIG. 14C illustrates representative mass spectroscopy imaging images.

FIGS. 15A to 15C are diagrams in a case where only the solvent is applied with the nebulizer after the vapor deposition in the second experiment, and FIG. 15A illustrates a microscopic observation image of a sample surface after matrix application, and FIG. 15B illustrates a mass spectrum acquired by averaging mass spectra obtained at all analytical points in an analytical range, and FIG. 15C illustrates representative mass spectroscopy imaging images.

FIGS. 16A to 16C are diagrams in a case where the matrix solution having low concentration is applied with the nebulizer after the vapor deposition in the second experiment, and FIG. 16A illustrates a microscopic observation image of a sample surface after matrix application, and FIG. 16B illustrates a mass spectrum acquired by averaging mass spectra obtained at all analytical points in an analytical range, and FIG. 16C illustrates representative mass spectroscopy imaging images.

FIGS. 17A to 17C are diagrams in which the results of the second experiment are compiled.

DESCRIPTION OF EMBODIMENTS

Hereinafter, several embodiments of a sample preparation method for MALDI according to the present invention will be described. This embodiment represents the preparation of a sample of a case where a tissue section originating from a living organism is measured with an imaging mass spectrometer.

First Embodiment

Figure 1:
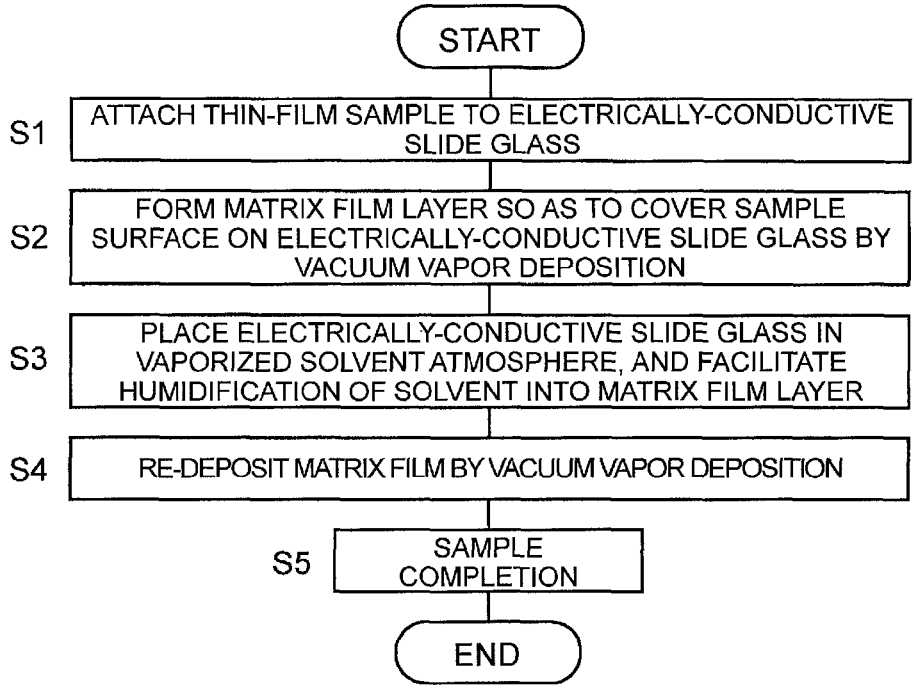
FIG. 1 is a flowchart illustrating a procedure of processing in a sample preparation method for MALDI in a first embodiment of the present invention.

FIG. 1 is a flowchart illustrating a procedure of processing in a sample preparation method for MALDI according to a first embodiment in the present invention. FIGS. 4A to 4D are cross-sectional conceptual diagrams of a prepared sample.

First, an operator places a thin-film sample 2 such as a tissue section, which is a target to be measured, on an electrically-conductive slide glass 1 that corresponds to a sample substrate in the present invention (Step S1). It is noted that a metallic plate such as stainless steel may be employed as the sample substrate, besides the electrically-conductive slide glass.

Subsequently, a film layer of a predetermined matrix substance is formed by a vacuum vapor deposition method so as to cover the whole of the sample 2 placed on the electrically-conductive slide glass 1 (Step S2). As the matrix substance, substances generally used in a conventional sample preparation method for MALDI, for example, DHB, CHCA (α-cyano-4-hydroxycinnamic acid), 9-AA (9-aminoacridine), or various substances described above besides these can be used without processing. A matrix film layer 3 including crystals which are very fine and dense is formed on the sample 2 by the vacuum vapor deposition method (see FIG. 4A). The thickness of the matrix film layer 3 is adequate on the order of about 0.5 to 1.5 [μm].

Figure 4A:
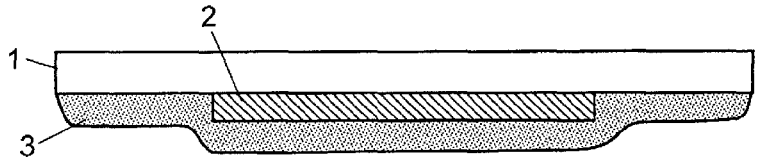
FIGS. 4A to 4D are cross-sectional conceptual diagrams of a sample prepared in the sample preparation method for MALDI according to the present invention.
Figure 4B:
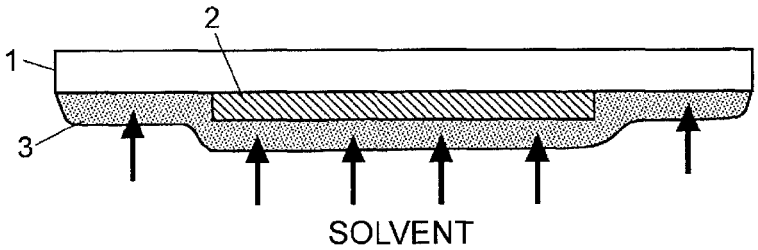
Figure 4C:
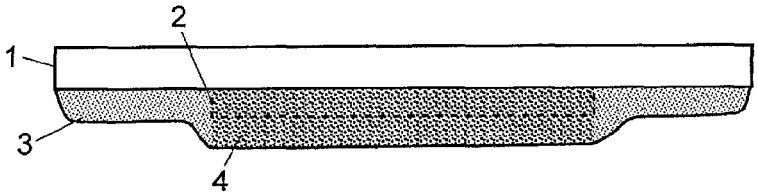

Subsequently, the electrically-conductive slide glass 1 on which the matrix film layer 3 is formed is placed in the atmosphere of the vaporized solvent, and the state is maintained in a predetermined period of time. As illustrated in FIG. 4B, this allows the solvent to gradually infiltrate into the matrix film layer 3 from the surface of the matrix film layer 3 being in contact with the vaporized solvent (Step S3). A solvent used in preparing the matrix solution by the conventional sample preparation method for MALDI, for example, methanol can be used as the solvent.

Figure 4D:
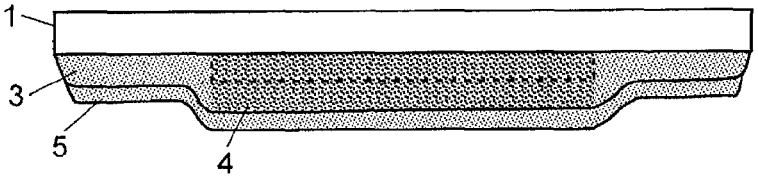

When the solvent humidified in the matrix film layer 3 reaches the sample 2 and then vaporizes, a substance to be measured in the sample (for example, protein, or administered medicine) is taken in the matrix substance and recrystallized, to form a cocrystal. The area of the cocrystal is illustrated by a reference number 4 in FIG. 4C. A film layer of the matrix substance is formed again by the vacuum vapor deposition method on the surface of the matrix film layer 3 on which the cocrystal area 4 is formed through humidification of the solvent (Step S4). As a result, as illustrated in FIG. 4D, the surface of the matrix film layer 3 on which the cocrystal area 4 is formed is covered with a matrix film layer 5. The thickness of the matrix film layer 5 is adequate on the order of about 0.5 to 1.5 [μm]. This completes preparation of the sample for MALDI (Step S5).

The formation of the matrix film layers 3 and 5 in Steps S2 and S4 can be typically conducted with a vacuum vapor deposition device for forming a film on a targeted object by heating and vaporizing the matrix substance. The humectation of the solvent into the matrix film layer 3 in Step S3 can be conducted in the following manner. That is, the electrically-conductive slide glass 1 on which the matrix film layer 3 is formed, is placed in the interior of a hermetically-sealed container in which a predetermined amount of solvent is stored, and installed so as to bridge above a support body made of hydrophobic resin. The hydrophobic support body is provided to prevent the direct contact of the electrically-conductive slide glass 1 with the solvent that gradually oozes upward. The solvent generally has high volatility, but when a solvent that is relatively hard to volatilize, for example, water is used, vaporization may be facilitated by appropriately heating the solvent or vibrating the solvent with ultrasonic waves. As this fills the interior of the hermetically-sealed container with the vaporized solvent, the solvent can be humidified in the matrix film layer 3 by maintaining its atmosphere for a predetermined period of time.

It is noted that, when the matrix film layer 5 is formed with the vacuum vapor deposition device, the matrix film layer 3 in which the solvent is humidified in the prior process needs not necessarily be dried. This is because when the electrically-conductive slide glass 1 is placed in the vacuum atmosphere to conduct the vacuum vapor deposition in Step S4, the solvent in the matrix film layer 3 vaporizes in a very short period of time and is removed.

The mass spectroscopy is conducted for thus prepared sample with the imaging mass spectrometer, and the sample has the following characteristics in the analysis.

As described above, the crystals of the matrix substance in the matrix film layers 3 and 5 formed by the vacuum vapor deposition are very fine and uniform. There occurs no needle-shaped crystallization, which causes the problem in the case where DHB and the like are applied to the sample surface by the spray method. When the laser beam having a microscopic diameter, which is narrowed for ionization, is irradiated to the sample, the crystals existed on the irradiated portion scatter, but the crystals do not scatter from the periphery of the irradiated portion because the crystals are fine, and therefore the substance to be measured is ionized in a state where the positional information on the sample 2 is secured. For this reason, as the irradiation diameter of the laser beam is reduced, the spatial resolution can be improved accordingly.

Also, when the laser beam having a large amount of energy is used, the substance originating from a living organism, in particular, protein or the like is prone to suffer damage such as denaturation. This is one of factors in reduction of the ion generation amount from the target substance when the laser beam is repeatedly irradiated at plural times for signal integration. In contrast, in the prepared sample described above, the cocrystal area 4 in which the substance to be measured is distributed is covered with the matrix film layer 5, and therefore, when the laser beam is irradiated to the substance to be measured, the particles of the substance in the matrix film layer 5 appropriately absorb the laser beam and alleviate the energy applied to the substance to be measured. This suppresses denaturation of the substance to be measured, and the ion generation amount can be increased, compared with a case where there is no matrix film layer 5. As a result, the larger amount of ions contribute to the mass spectroscopy, and high detection sensitivity can be achieved.

Second Embodiment

Figure 2:
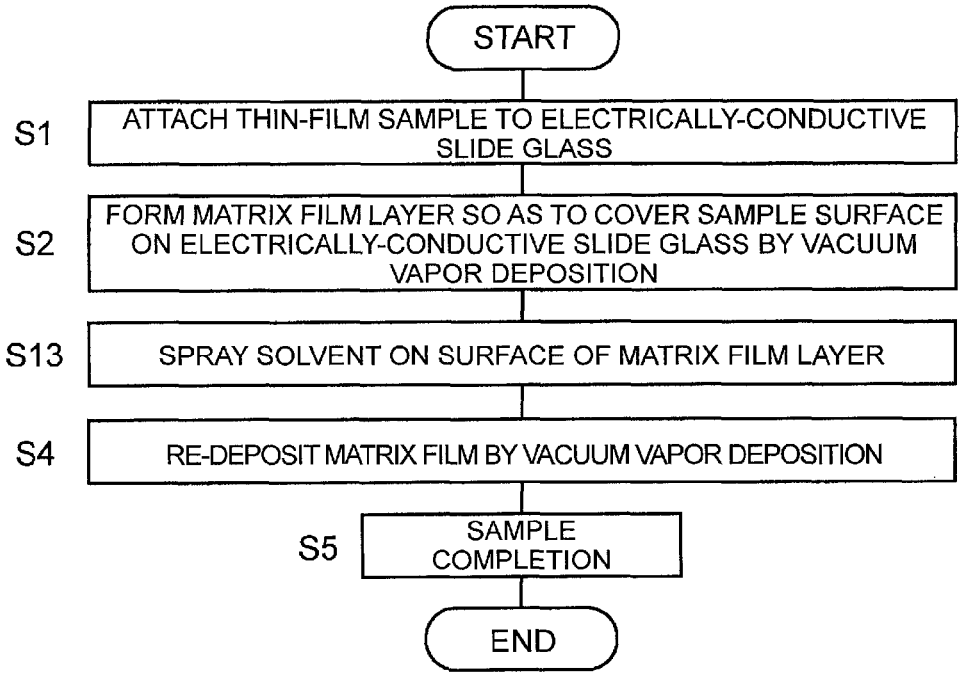
FIG. 2 is a flowchart illustrating a procedure of processing in a sample preparation method for MALDI in a second embodiment of the present invention.

FIG. 2 is a flowchart illustrating a procedure of processing in a sample preparation method for MALDI according to a second embodiment in the present invention. Only Step S3 in the first embodiment is changed to Step S13, and each step except for Step S13 is the same with that of the first embodiment.

In the sample preparation method for MALDI in the second embodiment, the solvent is directly sprayed with a spray device such as an airbrush on the surface of the matrix film layer 3 formed on the electrically-conductive slide glass 1. This attaches the minute droplets of the solvent to the surface of the matrix film layer 3 and infiltrates the solvent into the matrix film layer 3 (Step S13).

In the sample preparation method according to the first embodiment, it takes a time, for example, the order of several hours, to cause the matrix film layer 3 to be humidified sufficiently, whereas in the sample preparation method according to the second embodiment, time required for it can be considerably shortened. However, when an operator sprays the solvent to the matrix film layer 3, a difference in finishing quality of the sample frequently arises depending on the skill of the operator.

Third Embodiment

Figure 3:
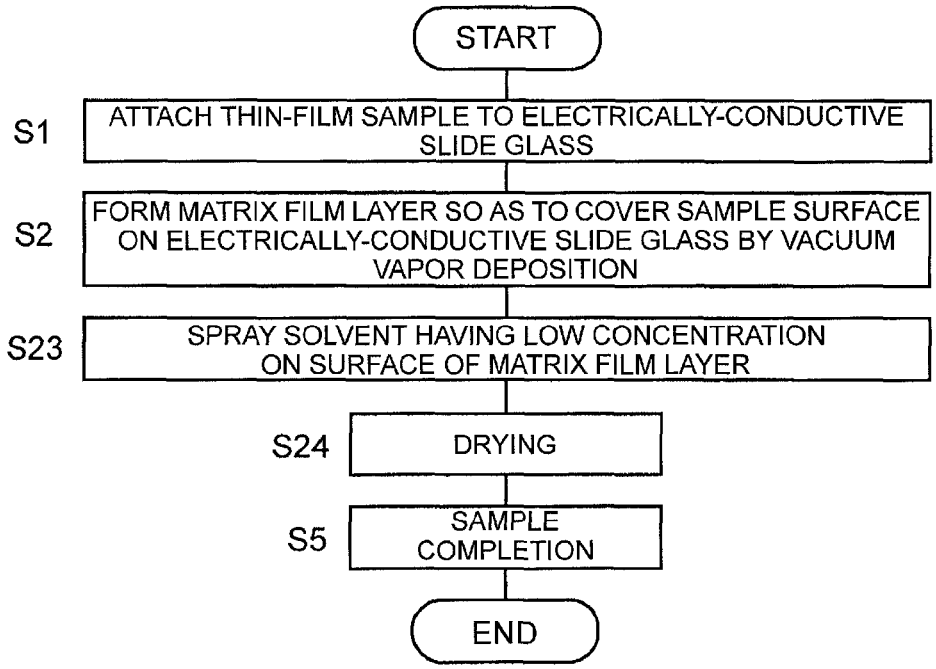
FIG. 3 is a flowchart illustrating a procedure of processing in a sample preparation method for MALDI in a third embodiment of the present invention.

FIG. 3 is a flowchart illustrating a procedure of processing in a sample preparation method for MALDI according to a third embodiment in the present invention. Although Steps S1 and S2 are exactly identical to those in the sample preparation method in the first embodiment, the processes in Step S3 onward are different.

In the sample preparation method for MALDI according to the third embodiment, after the matrix film layer 3 is formed on the electrically-conductive slide glass 1, the matrix solution having low concentration is directly sprayed with the spray device such as the airbrush on the surface of the matrix film layer 3 (Step S23), and subsequently the matrix film layer 3 is dried to remove the solvent (Step S24). This "low concentration" means the concentration lower than the concentration of the matrix solution used in a conventional general matrix application method, and specifically, the adequate concentration is about half to one fifth of the concentration of the saturation of the matrix solution.

The matrix substance in the matrix solution applied on the surface of the matrix film layer 3 formed by the vacuum vapor deposition grows with crystals which are fine and uniform in the matrix film layer 3 as a core, and therefore, even when the matrix solution is applied with non-uniform, uniform crystals are easily generated. For this reason, the crystals of the matrix substance generated by the applied matrix solution are fine and uniform. Also, the solvent in the matrix solution infiltrates into the matrix film layer 3 to reach the sample 2, and forms cocrystals of the substance to be measured and the matrix substance in the sample, and a film layer of the matrix substance including the crystals in the matrix solution is formed such that the matrix film layer 3 is covered with the film layer. Accordingly, a sample having cross-sectional structure similar to that of the sample prepared in the sample preparation method in the first and second embodiments illustrated in FIG. 4D is completed. In this way, the sample prepared in the sample preparation method in the third embodiment has the effects and advantages similar to those of the sample prepared in the sample preparation methods in the first and second embodiments.

Figure 5:
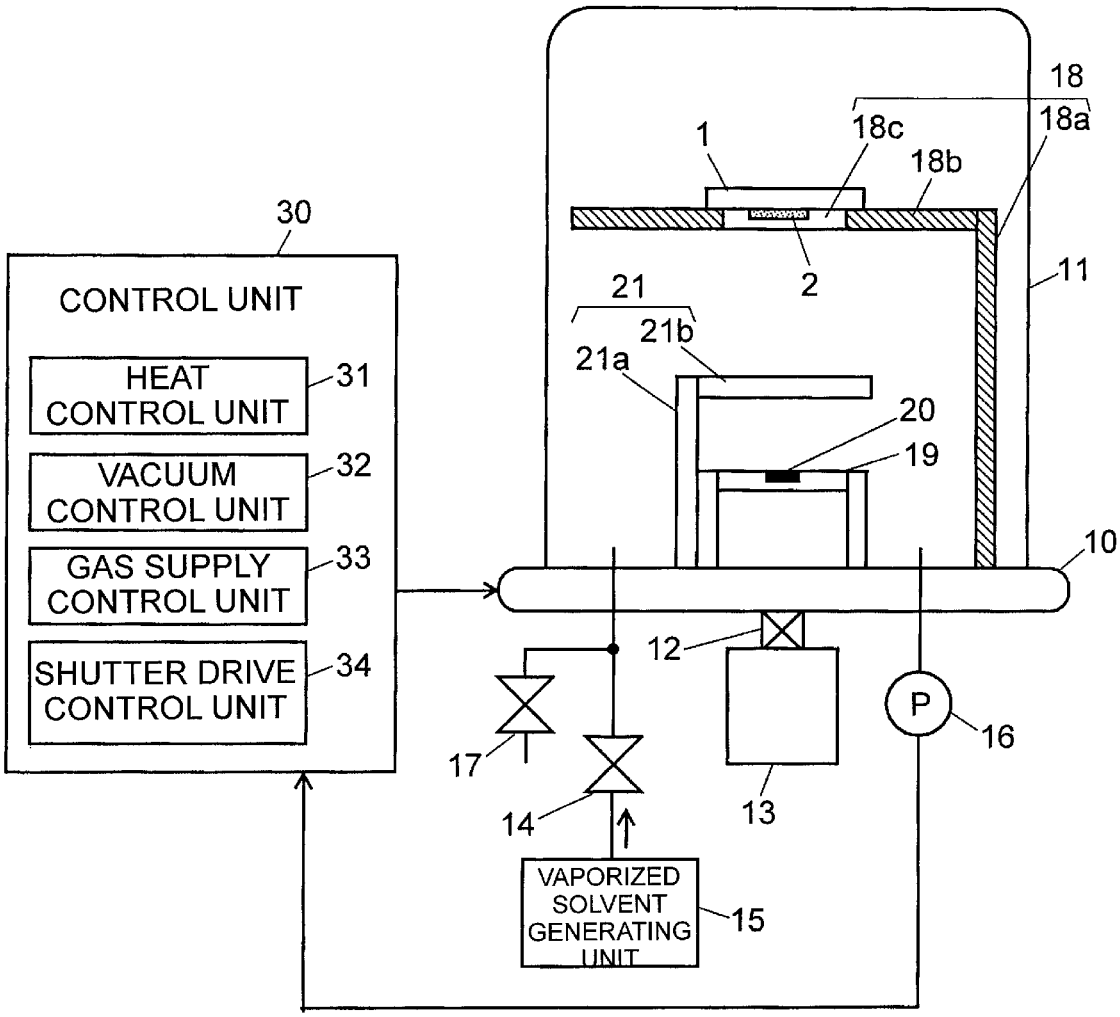
FIG. 5 is a schematic configuration diagram of a sample preparation device to implement the sample preparation method for MALDI in the first embodiment.

Next, an embodiment of the sample preparation device for implementing the sample preparation method in the first embodiment will be described. FIG. 5 is a schematic configuration diagram of the sample preparation device in the present embodiment.

The sample preparation device includes a base 10 and an openable/closable vacuum chamber 11, and a film forming chamber of which the interior can be maintained in a vacuum atmosphere is constituted by the base 10 and the vacuum chamber 11. A vacuum pump 13 and a vaporized solvent generating unit 15 are installed to the base 10 via a first valve 12 and a second valve 14, respectively, and further a vacuum gauge 16 for measuring a degree of vacuum in the film forming chamber and a leak valve 17 for reducing the degree of vacuum in the film forming chamber are installed to the base 10. A sample stage 18 on which the electrically-conductive slide glass (or a metal plate or the like) 1 is placed, a vapor deposition source 19 in which a matrix substance 20 is set, and a shutter 21 are installed in the film forming chamber.

The vapor deposition source 19 heats the matrix substance 20 in the film forming chamber under vacuum atmosphere so as to scatter the matrix substance 20 in the form of particles in the space. The types of vapor deposition source 19 include a boat type, a basket type, a crucible type, and a wire type, which is appropriately selected in accordance with the form or amount of the matrix substance to be used, or the direction in which the evaporated particles are scattered. In the example of FIG. 5, the boat type is used. The sample stage 18 consists of a support plate 18*b* horizontally arranged and having an opening 18*c* formed approximately in the center thereof, and a support rod 18*a* holding the support plate 18*b*. The opening 18*c* is provided immediately above the matrix substance 20 of the vacuum vapor deposition source 19, and the electrically-conductive slide glass 1 is placed on the support plate 18*b* in a manner that the attached sample 2 faces downward, namely is opposed to the matrix substance 20. The shutter 21 consists of a support shaft 21*a* and a blocking plate 21*b*. The shutter 21 causes the blocking plate 21*b* to rotate about the support shaft 21*a* in a predetermined angle range so as to block or pass the particles of the matrix substance advancing upward, namely, toward the electrically-conductive slide glass 1 from the vacuum vapor deposition source 19.

A control unit 30 that controls each unit for sample preparation in the sample preparation device includes functional blocks such as a heat control unit 31, a vacuum control unit 32, a gas supply control unit 33, and a shutter drive control unit 34. The control unit 30 can be embodied, for example, by a microcomputer including a CPU, a ROM, a RAM, a timer, and the like and can perform the control operation in the functional blocks, for example, in the process of executing control programs stored in the ROM or computational processing in accordance with control parameters by means of the CPU.

The operations in the case of automatically preparing the sample in the sample preparation device in the present embodiment will be described in association with each step in FIG. 1.

An operator puts the sample 2 on the electrically-conductive slide glass 1, and places the slide glass 1 on the support plate 18*b* of the sample stage 18 as illustrated in FIG. 5. Then, the operator puts an appropriate matrix substance such as DHB on the vapor deposition source 19, closes the vacuum chamber 11, and instructs the start using an operating unit not illustrated. Upon receiving the instruction, the vacuum control unit 32 of the control unit 30 closes the second valve 14 and the leak valve 17, activates the vacuum pump 13, and evacuates the film forming chamber through the first valve 12. After the start of the evacuation, the vacuum control unit 32 monitors gas pressure in the film forming chamber by means of the vacuum gauge 16, and when the actually-measured gas pressure reaches target gas pressure set in advance, the vacuum control unit 32 switches the operations of the vacuum pump 13 so as to maintain the actually-measured gas pressure in the vicinity of the target gas pressure.

When the actually-measured gas pressure reaches the target gas pressure, as illustrated in FIG. 5, the heat control unit 31 starts heating of the vapor deposition source 19 in a state where the shutter 21 is closed (state where the blocking plate 21*b* is positioned above the vapor deposition source 19). A heating temperature can be controlled by adjusting a heating current fed to a vapor deposition board. When the heating temperature reaches a target temperature set in advance (sublimation temperature of the matrix substance 20, for example, about 130 degrees Celsius in DHB), the heating current is adjusted for keeping the heating temperature approximately constant.

Upon elapse of a predetermined period of time after the heating temperature reaches the target temperature, the shutter drive control unit 34 opens the shutter 21. This causes the particles sublimated from the matrix substance 20 to reach the electrically-conductive slide glass 1, which starts the vapor deposition. For example, when the vapor deposition is conducted for a predetermined period of time so that the matrix film layer deposited on the electrically-conductive slide glass 1 has a predetermined thickness, the shutter 21 is closed, and the heating of the vapor deposition source 19 is stopped. It is noted that, preferably, the timing of stopping the vapor deposition is determined not by the time of the vapor deposition, but by a technique, for example, proposed in Patent Application No. 2012-159296 (see JP No. 2013-137294 A) by the applicant of the instant application in which the thickness of the matrix film layer is monitored, and the timing of stopping the vapor deposition is determined based on its monitoring result.

When time has passed to the extent that the temperature of the vapor deposition source 19 is sufficiently lowered after stopping the vapor deposition, the vacuum control unit 32 stops the vacuum pump 13 and closes the first valve 12. Then the gas supply control unit 33 opens the second valve 14 and supplies the vaporized solvent generated in the vaporized solvent generating unit 15 into the film forming chamber. The vaporized solvent generating unit 15 appropriately heats the solvent or vibrates the accumulated solvent with supersonic to generate the vaporized solvent. This fills the interior of the film forming chamber with the vaporized solvent, and the electrically-conductive slide glass 1 on which the matrix film layer is placed under vaporized solvent atmosphere. The solvent infiltrates into the matrix film layer by maintaining this state for a predetermined period of time (normally for about several hours).

When a predetermined period of time set in advance has passed, the gas supply control unit 33 closes the second valve 14 and stops supplying the vaporized solvent to the film forming chamber. Along with this, the vacuum control unit 32 activates the vacuum pump 13 again, opens the first valve 12, and evacuates the film forming chamber. Then, as is the same with the first formation of the matrix film layer, when the gas pressure in the film forming chamber reaches the target gas pressure, the heating of the vapor deposition source 19 is started, and when a predetermined period of time has passed after the heating temperature reaches the target temperature, the shutter 21 is opened, and the vapor deposition is executed.

Then, when it is determined that the second matrix film layer has a predetermined thickness determined in advance, the shutter 21 is closed, and the heating of the vapor deposition source 19 and the vacuum vapor deposition are stopped, and the all processes complete.

Naturally, the operator may manually perform a part or the whole of works or operations, instead of automatically conducting a series of works all, ranging from the initial vacuum vapor deposition to the completion of all processes. Specifically, a part or the whole of works such as the opening/closing of the valves 12, 14, 17, and the like, the activating and stopping of the vacuum pump 13, the heating and stopping of the vapor deposition source 19, the adjusting of the heating current, and the opening/closing of the shutter 21 may be carried out by instructions by the operator. Although these works takes time, the sample can be prepared without removing the electrically-conductive slide glass 1 on which the sample 2 is attached after it is stored in the film forming chamber. This sufficiently reduces the burdens imposed on the operator compared with a case where the solvent infiltration into the matrix film layer is conducted outside of the film forming chamber.

Subsequently, the procedure and results of experiments implemented to verify the effects of the sample preparation method for MALDI according to the present invention will be described.

[Procedure and Results of First Experiment]

Figure 6:
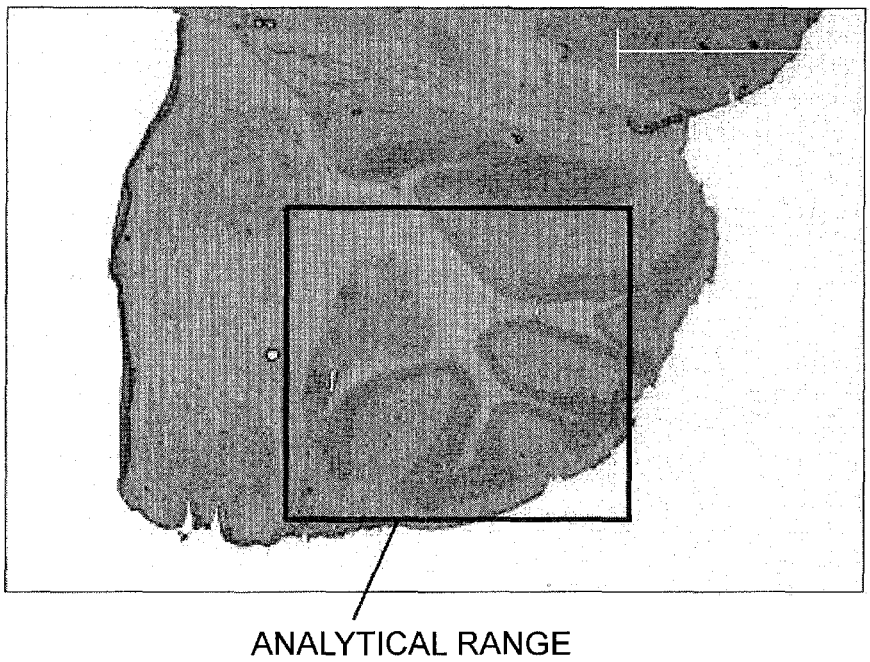
FIG. 6 is a photograph illustrating an analytical range in a sample to be measured that is used in a first experiment so as to verify the effects of the present invention.

In this experiment, a sample to be measured is 10 [μm] section of a mouse cerebellum. FIG. 6 is a photograph illustrating an analytical range in the sample. The matrix substance is DHB, a used mass spectrometer is an imaging mass spectrometer manufactured by Shimadzu Corporation, the diameter of laser emitted from an MALDI ion source is 5 [μm], the pitch of a laser spot on the sample is 10 [μm], analytical points in the analytical range is 250×250, and the range of a mass-to-charge ratio is m/z 400 to 1200. Also, in the sample preparation method, three methods including the method in the third embodiment (referred to as "vapor deposition+spray method" in the description and drawings below), a conventional method with only the vapor deposition with no spray (referred to as "vapor deposition method" in the description and drawings below), and a conventional spray method (referred to as "spray method" in the description and drawings below) are examined. It is noted that a vapor deposition time in the vapor deposition+spray method is three minutes, and a vapor deposition time in the vapor deposition method is 12 minutes.

Figure 7A:
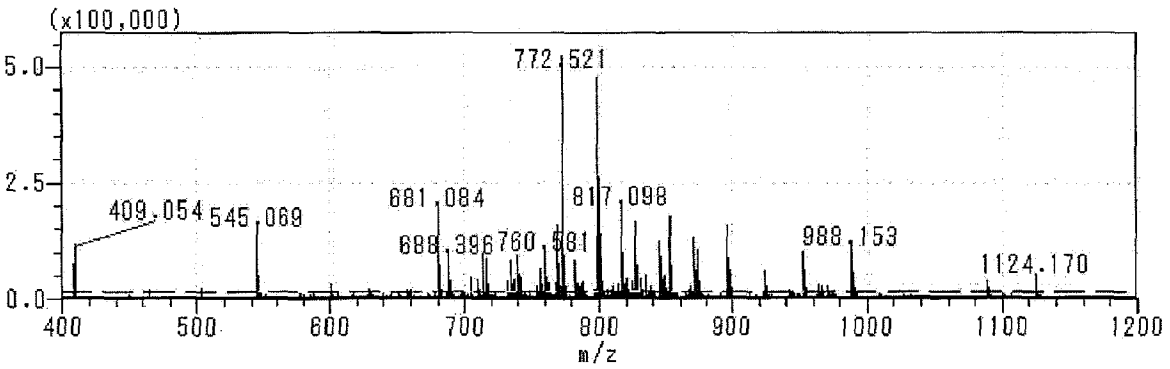
FIGS. 7A to 7C are mass spectra acquired by averaging mass spectra obtained at tall analytical points in an analytical range in the first experiment.
Figure 7B:
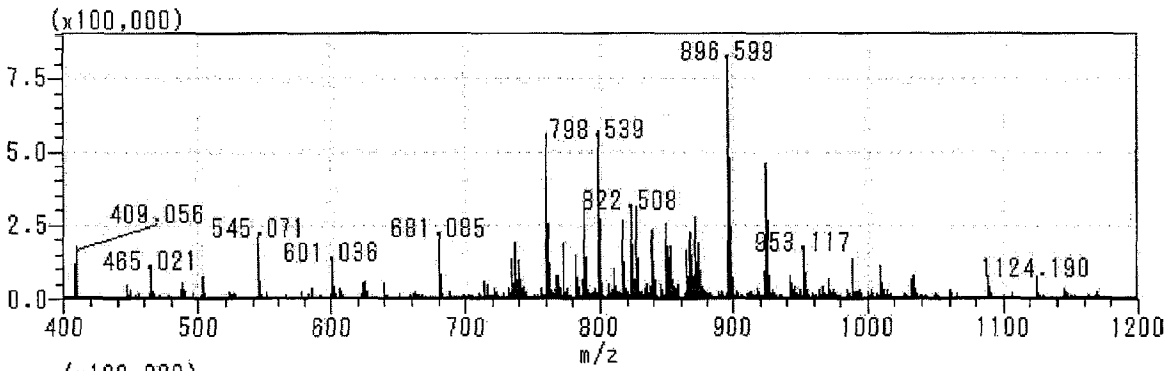
Figure 7C:
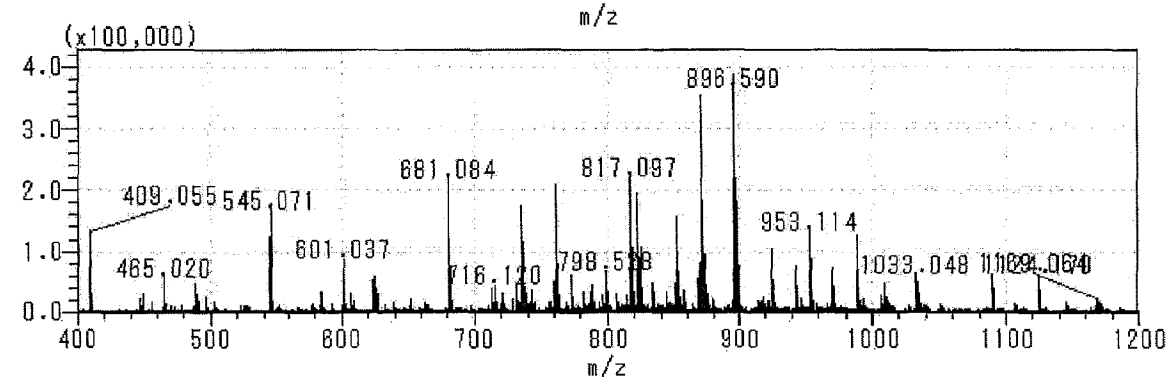
Figure 8A:
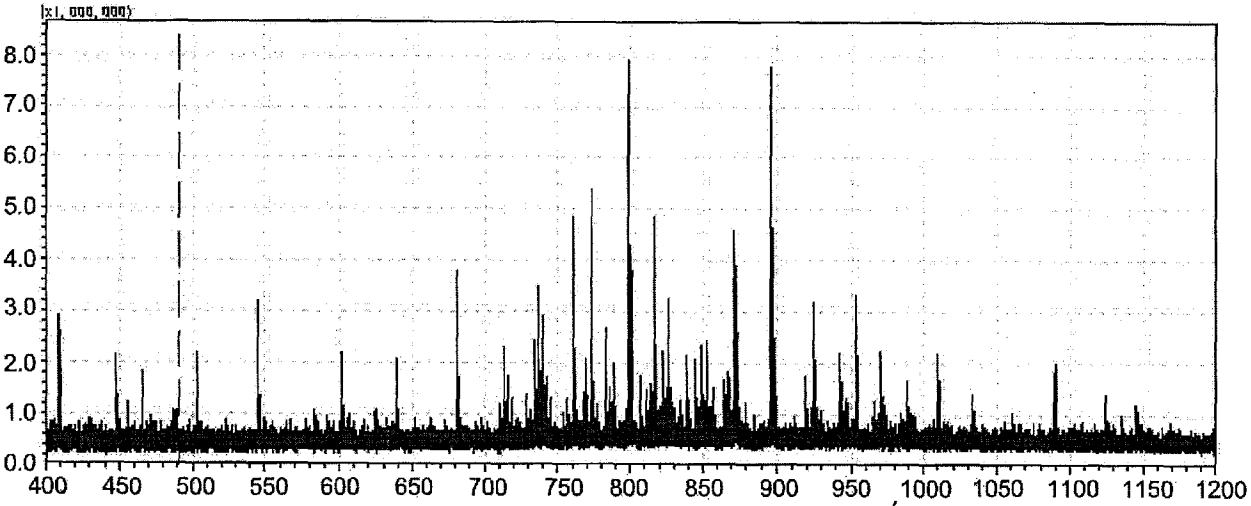
FIGS. 8A and 8B are mass spectra acquired by averaging mass spectra obtained at all analytical points in the analytical range in the first experiment.
Figure 8B:
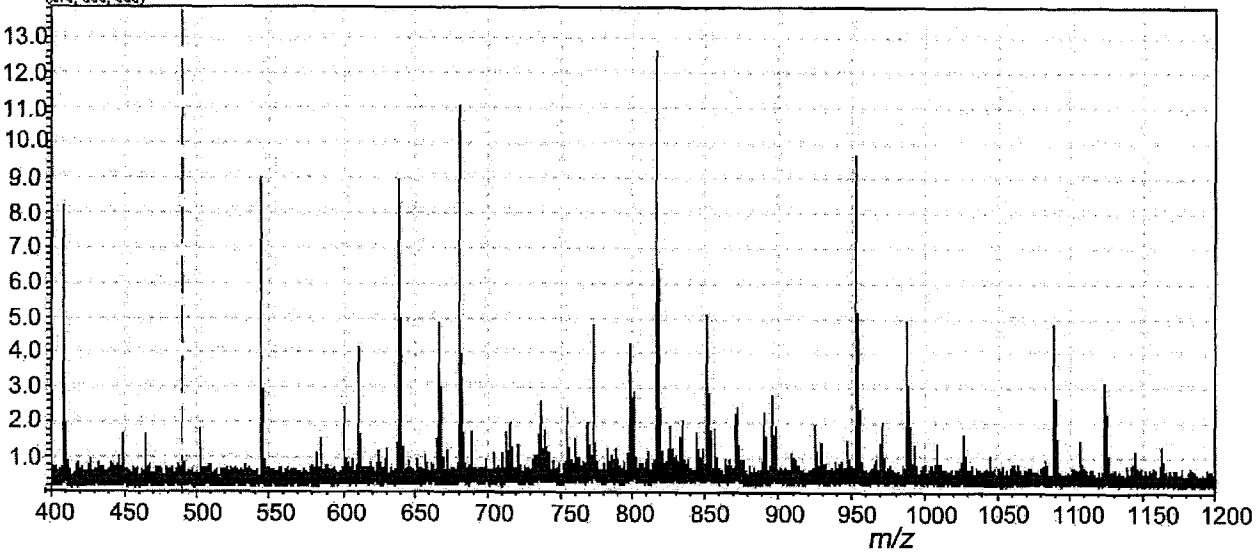

FIGS. 7A, 7B and 7C are mass spectra acquired by averaging mass spectra obtained at all analytical points (250×250 points). FIGS. 8A and 8B are diagrams illustrating only the mass spectra in the vapor deposition+spray method and the vapor deposition method. It finds from these diagrams that the spray method has the largest number of detected peaks, and the vapor deposition+spray method has the second largest number of detected peaks, and the vapor deposition method has the least number of detected peaks. Also, it finds that the number of detected peaks is few only in the least method, but the number of detected peaks increases by combining a spray having a low concentration solvent with this.

Figures 9A, 9B, 9C:
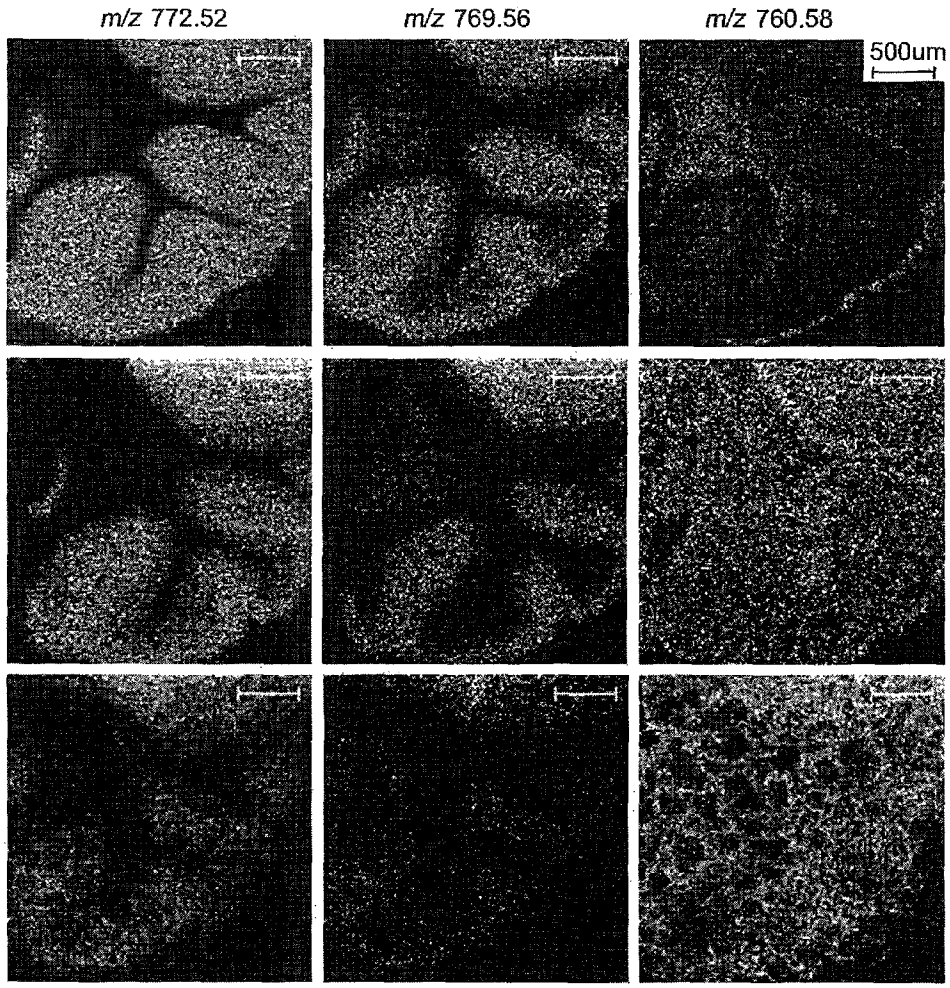
FIGS. 9A to 9C are diagrams illustrating the comparison of mass spectroscopy imaging images obtained with an imaging mass spectrometer in the first experiment.

FIGS. 9A, 9B and 9C are diagrams illustrating the comparison of mass spectroscopy imaging images representing the two-dimensional distribution of a substance having a specific mass-to-charge ratio, which is obtained by the imaging mass spectrometer. In the case of the spray method, only unclear images are obtained at m/z 769.56, and images at m/z 760.58 is incapable of reflecting the boundary between tissues on the sample. That is, the number of detected peaks is large in the spray method, whereas the mass spectroscopy imaging image has low sharpness, which is not suitable for the imaging mass spectroscopy. On the other hand, in the vapor deposition method and the vapor deposition+spray method, very clear images are obtained compared with the spray method.

Figure 10A:
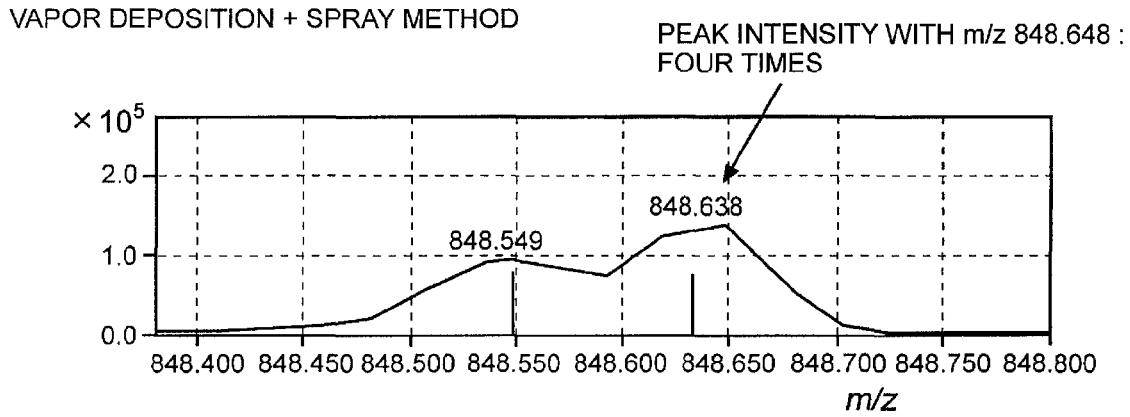
FIGS. 10A and 10B are enlarged diagrams of a mass spectrum in a range of m/z 848.400 to 848.800 in the first experiment.
Figure 10B:
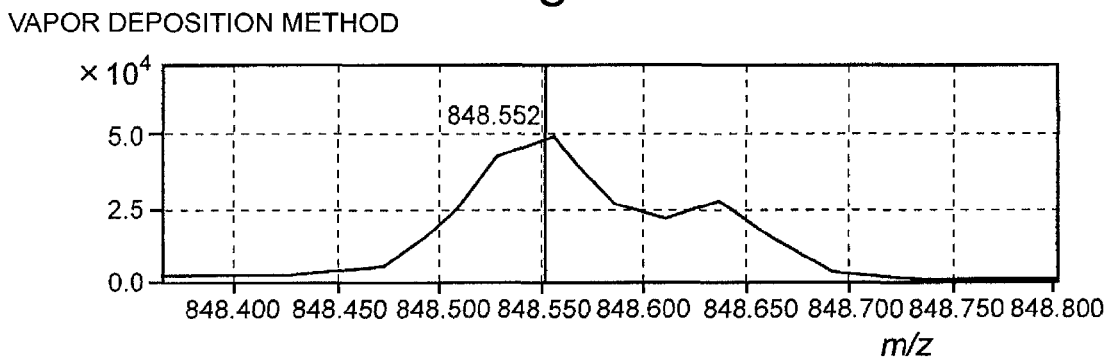
Figure 11A:
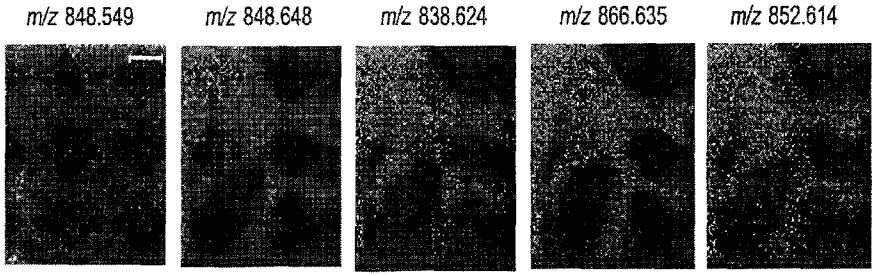
FIGS. 11A and 11B are diagrams illustrating the mass spectroscopy imaging images in the vicinity of a mass-to-charge ratio range illustrated in FIGS. 10A and 10B.
Figure 11B:
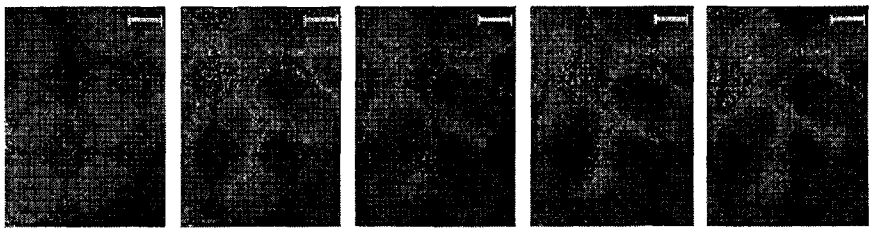

FIGS. 10A and 10B are mass spectra in the narrow range of a mass-to-charge ratio of m/z 848.400 to 848.800. Attention needs to be paid in that the scale of a vertical axis (signal intensity axis) of FIG. 10A is ten times as much as that of FIG. 10B. For example, when peak intensity at m/z 848.648 is observed, the vapor deposition+spray method is four times as much as the spray method. That is, the vapor deposition+spray method represents high sensitivity, compared with the vapor deposition method. FIGS. 11A and 11B are mass spectroscopy imaging images in the vicinity of this mass-to-charge ratio range. As described above, the vapor deposition+spray method is higher in signal detection sensitivity than the vapor deposition method, and therefore the intensity value of a pixel in which the substance exists on the mass spectroscopy imaging image, increases, and as a result, a position in which the substance exists is clearly illustrated can be confirmed.

Based on the results above, the vapor deposition+spray method which is one technique of the present invention is suitable, in particular, for the imaging mass spectroscopy, and the following advantages are confirmed: the number of detected peaks is large (that is, further many pieces of information on components is obtained) compared with the simple vapor deposition method, and a clear mass spectroscopy imaging image can be obtained, in particular, a clear mass spectroscopy imaging image for even a relatively small amount of components can be obtained, thanks to high sensitivity.

[Procedure and Results of Second Experiment]

In the second experiment, a 10 [μm] section of a liver of a normal mouse has been used as a sample to be measured. Also, in this experiment, the matrix substance is CHCA, a used mass spectrometer is an imaging mass spectrometer manufactured by Shimadzu Corporation, the diameter of laser emitted from the MALDI ion source is 20 [μm], the pitch of a laser spot on the sample is 25 [μm], analytical points in the analytical range is 70×52, and the range of a mass-to-charge ratio is m/z 100 to 670. A vapor deposition device manufactured by Shimadzu Corporation is used for the vapor deposition of the matrix substance on the surface of a sample placed on the electrically-conductive sample glass, and vacuum evaporation conditions are the following: gas pressure is 10 [Pa], a temperature of the vapor deposition source is 240 degrees Celsius, and a vapor deposition time is about four minutes. The gas pressure in this time is quite a low degree of vacuum as a general vapor deposition condition. It is noted that the vapor deposition time actually does not determine the stop timing of vapor deposition based on a time, but the vapor deposition is stopped at a time point when two interference fringes emerged on the surface of a deposited film layer become visible. As a result of this procedure, the vapor deposition time is about four minutes, and the thickness of the matrix film layer is about 0.6 [μm].

For the sample preparation methods, the following four types of method are examined, in addition to "vapor deposition method" in the first experiment.

(1) Only the solvent (75% ethanol, 25% water) is sprayed with the airbrush after the matrix substance is deposited (hereinafter referred to "vapor deposition+solvent spray method").

(2) A low-concentration matrix solution (CHCA having concentration of 10 [mg/mL] is dissolved into the solvent described above) is sprayed with the airbrush after the matrix substance is deposited (hereinafter referred to "vapor deposition+low-concentration solution spray method").

(3) Only the solvent (75% ethanol, 25% water) is sprayed with a nebulizer after the matrix substance is deposited (hereinafter referred to "vapor deposition+solvent nebulizer method").

(4) A low-concentration matrix solution similar to (2) is sprayed with the nebulizer after the matrix substance is deposited (hereinafter referred to "vapor deposition+low-concentration solution nebulizer method").

In (3) and (4), the spray with the nebulizer is repeated ten times for 10 seconds (the intervals are ten seconds or more) so as to carry out intermittent spray. In this way, by use of the nebulizer, considerably fine droplets are acquired from the sprayed solution compared with the spray with the airbrush.

FIGS. 12A, 12B and 12C are diagrams in the case of executing the vapor deposition method. FIG. 12A illustrates a microscopic observation image of the sample surface after matrix application, FIG. 12B illustrates a mass spectrum acquired by averaging mass spectra obtained at all analytical points in the analytical range, and FIG. 12C illustrates representative mass spectroscopy imaging images.

FIGS. 13A, 13B and 13C are diagrams in the case of executing vapor deposition+solvent spray method. FIG. 13A illustrates a microscopic observation image of the sample surface after matrix application, FIG. 13B illustrates a mass spectrum acquired by averaging mass spectra obtained at all analytical points in the analytical range, and FIG. 13C illustrates representative mass spectroscopy imaging images.

FIGS. 14A, 14B and 14C are diagrams in the case of executing vapor deposition+low-concentration solution spray method. FIG. 14A illustrates a microscopic observation image of a sample surface after matrix application, FIG. 14B illustrates a mass spectrum acquired by averaging mass spectra obtained at all analytical points in an analytical range, and FIG. 14C illustrates representative mass spectroscopy imaging images.

FIGS. 15A, 15B and 15C are diagrams in the case of executing vapor deposition+solvent nebulizer method. FIG. 15A illustrates a microscopic observation image of a sample surface after matrix application, FIG. 15B illustrates a mass spectrum acquired by averaging mass spectra obtained at all analytical points in an analytical range, and FIG. 15C illustrates representative mass spectroscopy imaging images.

FIGS. 16A, 16B and 16C are diagrams in the case of executing vapor deposition+low-concentration solution nebulizer method. FIG. 16A illustrates a microscopic observation image of a sample surface after matrix application, FIG. 16B illustrates a mass spectrum acquired by averaging mass spectra obtained at all analytical points in an analytical range, and FIG. 16C illustrates representative mass spectroscopy imaging images.

FIGS. 12B, 13B, 14B, 15B, and 16B show the mass spectrum acquired by averaging the mass spectra obtained at all analytical points (70×52 points). Also, FIGS. 12C, 13C, 14C, and 15C show the mass spectroscopy imaging images of three substances of spermidine, spermine, and CHCA (adduct ion) which is a matrix.

It finds from these diagrams that general detection sensitivity is considerably low in the vapor deposition method in which the solvent or the low-concentration solution is not sprayed, and that the spermidine or the spermine assumed to be normally distributed over the whole of the sample on the mass spectroscopy imaging images, is hardly observed. In contrast, when the solution, in particular, the low-concentration solution is sprayed with the spray device or with the nebulizer, the detection sensitivity is generally improved, and the number of detected peaks increases. Also, the intensity value of a pixel corresponding to the spermidine or the spermine increases on the mass spectroscopy imaging images, and therefore it can be confirmed that the positions in which these substances exist are clearly shown. It is noted that the detection sensitivity in the solvent sprayed with the nebulizer is improved to the extent of that of the low-concentration solution spray, whereas the improvement of the detection sensitivity cannot be confirmed when the solvent is sprayed with the spray device. The reason is assumed that this is due not to the difference between the spray methods with the airbrush and the nebulizer but to the size of the droplet to be sprayed.

FIGS. 17A, 17B and 17C are diagrams illustrating compiled experimental results of a peak area, an intensity ratio to a peak originating from the matrix, and the intensity ratio in the case of only the vapor deposition, with regard to peaks corresponding to spermidine, spermine, and CHCA, which emerge on the spectra illustrated in FIGS. 12B, 13B, 14B, 15B, and 16B. In view of FIG. 17B, it can be found that the spray implemented with the nebulizer in any of the solvent spray and the low-concentration solution spray increases the intensity ratio of the peak of the spermidine or the spermine. These substances are water-soluble polyamines, and as for these water-soluble substances, it can be concluded that when an organic solvent mixed with water is sprayed without spraying the matrix solution intentionally, the substantially great improved effects of the detection sensitivity are obtained.

Also, as described above, when the low-concentration solution is sprayed, the detection sensitivity of the substance such as polyamines is enhanced, but as is evident from FIG. 17C, the increase in intensity of the peak originating from the matrix is conspicuous. In this way, when any of the solvent and the low-concentration solution is used, it can be said that the implementation of the spray of not large droplets but fine droplets is desirable.

Also, the vapor deposition is carried out under sufficiently high degree of vacuum (gas pressure of the order of $10^{-3}$ [Pa]) in the first experiment, whereas the degree of vacuum in the case of vapor deposition of the matrix substance is considerably low in the second experiment. In this way, it finds that favorable analytical results can be obtained only by appropriately controlling the thickness of the matrix film layer even when the vapor deposition of the matrix substance is carried out under the condition with a low degree of vacuum.

It is noted that any of the embodiments described above is a mere example of the present invention, and it is obvious that changes, additions, and modifications are appropriately included in the scope of the claims of the instant application within the scope of the gist of the present invention.

REFERENCE SIGNS LIST

1 . . . Electrically-conductive Slide Glass
2 . . . Sample
3, 5 . . . Matrix Film Layer
4 . . . Cocrystal Area
10 . . . Base
11 . . . Vacuum Chamber
12 . . . First Valve
13 . . . Vacuum Pump
14 . . . Second Valve
15 . . . Vaporized Solvent Generating Unit
16 . . . Vacuum Gauge
17 . . . Leak Valve
18 . . . Sample Stage
18*a* . . . Support Rod
18*b* . . . Support Plate
18*c* . . . Opening
19 . . . Vapor Deposition Source
20 . . . Matrix Substance
21 . . . Shutter
21*a* . . . Support Shaft
21*b* . . . Blocking Plate
30 . . . Control Unit
31 . . . Heat Control Unit
32 . . . Vacuum Control Unit
33 . . . Gas Supply Control Unit
34 . . . Shutter Drive Control Unit

The invention claimed is:

1. A sample preparation method for MALDI, the sample preparation method for preparing a sample for mass spectroscopy using a matrix assisted laser desorption ionization method and configured to execute steps, comprising:

a) a matrix depositing step for vaporizing a matrix substance in vacuum and depositing the matrix substance to form a matrix layer on a surface of a sample substrate on which a sample to be measured is placed;

b) a solvent introducing step for bringing a predetermined solvent in gaseous or liquid into contact with a surface of the matrix film layer formed on the sample substrate so as to infiltrate the solvent into the matrix film layer; and c) a matrix re-depositing step for vaporizing the matrix substance in vacuum and depositing the matrix substance again on the surface of the matrix film layer in a state where the solvent is infiltrated, or in a state where the infiltrated solvent is volatilized.

2. The sample preparation method for MALDI according to claim 1, wherein, in the solvent introducing step, the sample substrate on which the matrix film layer is formed is left in a container filled with a vaporized solvent for a predetermined period of time so as to infiltrate the solvent into the matrix film layer.

3. The sample preparation method for MALDI according to claim 1, wherein, in the solvent introducing step, the solvent is sprayed on the surface of the matrix film layer formed on the sample substrate so as to infiltrate the solvent into the matrix film layer.

4. A sample preparation method for MALDI, the sample preparation method for preparing a sample for mass spectroscopy using a matrix assisted laser desorption ionization method and configured to execute steps, comprising:

a) a matrix depositing step for vaporizing a matrix substance in vacuum and depositing the matrix substance on a surface of a sample substrate on which a sample to be measured is placed; and b) a solution introducing step for spraying a matrix solution having a concentration of the matrix substance that is lower than a concentration of the matrix substance in the matrix depositing step a) on a surface of a matrix film layer formed on the sample substrate so as to infiltrate the solution into the matrix film layer.

* * * * *